US010898935B2

(12) United States Patent
Goto et al.

(10) Patent No.: US 10,898,935 B2
(45) Date of Patent: Jan. 26, 2021

(54) STAIN REMOVAL DEVICE AND STAIN REMOVAL METHOD

(71) Applicant: FUJI SHOJI CO., LTD., Hashima (JP)

(72) Inventors: Katsuhiro Goto, Hashima (JP); Nobuhiro Kanazawa, Hashima (JP); Tatsuya Banno, Hashima (JP)

(73) Assignee: FUJI SHOJI CO., LTD., Hashima (JP)

( * ) Notice: Subject to any disclaimer, the term of this patent is extended or adjusted under 35 U.S.C. 154(b) by 0 days.

(21) Appl. No.: 14/911,208

(22) PCT Filed: Aug. 26, 2013

(86) PCT No.: PCT/JP2013/072725
§ 371 (c)(1),
(2) Date: Feb. 9, 2016

(87) PCT Pub. No.: WO2015/029108
PCT Pub. Date: Mar. 5, 2015

(65) Prior Publication Data

US 2016/0175905 A1 Jun. 23, 2016

(51) Int. Cl.

| | |
|---|---|
| ***B21C 43/04*** | (2006.01) |
| ***B08B 5/02*** | (2006.01) |
| ***B08B 1/02*** | (2006.01) |

(52) U.S. Cl.
CPC ..... *B21C 43/04* (2013.01); *B08B 1/02* (2013.01); *B08B 5/023* (2013.01)

(58) Field of Classification Search
None
See application file for complete search history.

(56) References Cited

U.S. PATENT DOCUMENTS 2,335,196 A * 11/1943 Pecsok ..... B08B 1/02 29/81.03
4,817,645 A * 4/1989 Vogel ..... B21C 43/04 134/122 R (Continued)

FOREIGN PATENT DOCUMENTS

DE 100 01 591 A1 7/2001
JP 5-185040 A 7/1993

(Continued)

OTHER PUBLICATIONS

International Search Report dated Nov. 12, 2013 in PCT/JP13/072725 Filed Aug. 26, 2013.

(Continued)

*Primary Examiner* — Mikhail Kornakov
*Assistant Examiner* — Pradhuman Parihar
(74) *Attorney, Agent, or Firm* — Oblon, McClelland, Maier & Neustadt, L.L.P.

(57) ABSTRACT

A stain removal device and a stain removal method for removing stain, such as scale residue or smut from the surface of a wire material by a cord-shaped member, includes a wire material winding device for winding a wire material on the surface of which the stain is deposited, a cord-shaped member which is wound on the wire material and wipes off stain attached on the surface of a wire material by a sliding movement relative to the wire material, and a cord-shaped member feed device for feeding the cord-shaped member relative to the wire material. The stain removal method includes linear feeding of a wire material, winding a cord-shaped member on the wire material, wiping off the stain attached on the surface of the wire material by rolling up the cord shaped member, and blowing air onto the surface of the wire material to blow away stain remaining thereon.

4 Claims, 4 Drawing Sheets

(56) References Cited

U.S. PATENT DOCUMENTS

| | | | | |
|---|---|---|---|---|
| 5,613,286 | A * | 3/1997 | McCabe | B21C 43/04 15/308 |
| 9,352,423 | B2 * | 5/2016 | Vernam | B24B 27/033 |
| 2004/0020021 | A1 | 2/2004 | Ahrens | |
| 2005/0250659 | A1 * | 11/2005 | Howey | B08B 1/00 510/170 |
| 2007/0056607 | A1 * | 3/2007 | Boockmann | B08B 1/02 134/6 |
| 2008/0250582 | A1 * | 10/2008 | Sasagawa | B08B 1/00 15/1.51 |

FOREIGN PATENT DOCUMENTS

| | | | |
|---|---|---|---|
| JP | 6-182429 | A | 7/1994 |
| JP | 7-155660 | A | 6/1995 |
| JP | 2000-218240 | A | 8/2000 |
| WO | 2011/013445 | A1 | 2/2011 |

OTHER PUBLICATIONS

Office Action dated Jun. 13, 2017 in Japanese Patent Application No. 2015-533798 (with English translation).
Offer of Information of third party observations dated Jul. 13, 2017 in German Patent Application No. 11 2013 007 364.1.
Indian Office Action issued in Indian Patent Application No. 201617003097 dated Dec. 23, 2019.

* cited by examiner

STAIN REMOVAL DEVICE AND STAIN REMOVAL METHOD

TECHNICAL FIELD

This invention relates to a stain removal device and a stain removal method for removing a stain such as a scale residue or a smut deposited on a wire surface by wiping off the stain using a cord shaped member.

BACKGROUND ART

As described in a Patent Literature 1 for example, in a manufacturing line for manufacturing a bead wire, which is used as a reinforcement member of an automobile tire, by wire-drawing processing, generally, an oxide layer formed on a wire material is removed by mechanical de-scaling treatment before performing the wire-drawing processing for making the bead wire, as a pre-processing for the wire-drawing processing. However, by such mechanical de-scaling treatment, the oxide layer cannot completely be removed and the scale residue remains on the surface of the wire material. Accordingly, conventionally, the scale residue still remained on the wire material is removed by brushing off using a wire brush after the mechanical de-scaling treatment, or alternatively, is removed by ultrasonic cleaning.

As another case, when a plating processing is performed on the wire material which has been drawn to a predetermined size, since the oxide layer has been formed on the wire material surface upon a heat treatment process which is a pre-processing for the plating processing, usually, a de-scaling treatment is performed for removing the formed oxide layer by immersing the wire material in a treatment liquid, such as hydrochloric acid liquid or the like. However, when the wire material is immersed in the treatment liquid, such as hydrochloric acid or the like, a smut is newly formed on the surface of the wire material and when the wire material with the smut is plated, the plated outer surface turns brownish, which becomes an obstructive factor to plating performance capability and accordingly, such method is considered as "not preferable".

CITATION LIST

Patent Literature

Patent Literature 1: WO2011-013445

SUMMARY OF INVENTION

Technical Problem(s)

It is difficult to completely remove the scale residue on the wire material before the wire-drawing treatment by brushing off the scale residue using a wire brush. It is very expensive to perform an ultrasonic cleaning and when such ultrasonic cleaning method is performed, an exchange of oscillator or the like becomes a factor of increase in cost. On the other hand, when the treatment liquid, such as hydrochloric acid or the like, is used for removing the oxide layer before plating processing, a facility for disposing the wasted liquid becomes necessary, which leads to an increase in cost.

Accordingly, this invention was made in consideration with the above-mentioned situation and the objective of the invention is to provide a stain removal device and a stain removal method for removing a stain such as a scale residue or a smut deposited on a wire surface by using a cord shaped member, without using any chemicals or ultrasonic waves.

Solution to Problem(s)

The feature of the invention associated with aspect 1 is characterized in that the stain removal device for removing a stain such as a scale residue or a smut on a surface of a wire material includes a wire material winding device for feeding the wire material in a feeding direction and winding the same, on the surface of which the stain such as the scale residue or the smut is attached, a cord shaped member which is wound on the wire material and wipes off the stain attached on the surface of the wire material by a sliding movement relative to the wire material and a cord shaped member feeding device for feeding the cord shaped member relative to the wire material by drawing the cord shaped member in a radial direction relative to the wire material and guiding the same at an inlet side for the cord shaped member to be extended and fed in a feeding direction thereof along an extending direction of the wire material and wound around the wire material in a spiral manner and thereafter drawing out the cord shaped member by guiding the same at an outlet side from the extending direction of the wire material toward a radially outward direction relative to the wire material.

The feature of the invention associated with aspect 2 is characterized in that in addition to the feature of aspect 1 an air blowing device is provided for blowing air to the surface of the wire material which has been wiped by the cord shaped member to blow off a remain of the stain attached on the surface of the wire material.

The feature of the invention associated with aspect 3 is characterized in that in addition to the feature of the above aspect 1 or 2 the feeding direction of the wire material fed by the wire material winding device is set to be a same direction with the feeding direction of the cord shaped member fed by the cord shaped member feeding device.

The feature of the invention associated with aspect 4 is characterized in that in addition to the feature of any one of the aspects 1 through 3 the cord shaped member feeding device includes a guide roller for guiding at the inlet side the cord shaped member drawn in the radial direction relative to the wire material to be extended along an extending direction of the wire material, a guide roller for drawing out the cord shaped member by guiding the cord shaped member at the outlet side from the extending direction of the wire material toward the radially outward direction relative to the wire material, a feed out roller for feeding out one end of the cord shaped member at the outlet side and a restricting device for restricting a movement of another end of the cord shaped member at the inlet side.

The feature of the invention associated with aspect 5 is characterized in that in addition to the feature of any one of the aspects 1 through 4 the stain removal device further includes a water supply device which is provided at an upper stream side in the feeding direction of the wire material with respect to the cord shaped member wound on the wire material to drop water on the surface of the wire material.

The feature of the invention associated with aspect 6 is characterized in that in addition to any feature of the aspects 1 through 5 the cord shaped member is formed by a hemp cord which has a high water absorption property.

The feature of the invention associated with aspect 7 is characterized in that in addition to any feature of the aspects 1 through 6, a plurality of soil removal devices is arranged in the feeding direction of the wire material.

The feature of the invention associated with aspect 8 is characterized in that the stain removal method for removing a stain such as a scale residue or a smut on a surface of a wire material comprising the steps of linearly feeding the wire material on the surface of which the stain such as the scale residue or the smut is attached, drawing a cord shaped member in a radial direction relative to the wire material, guiding the cord shaped member at an inlet side for the cord shaped member to be extended and fed in a feeding direction thereof along an extending direction of the wire material and wound around the wire material in a spiral manner and thereafter drawing out the cord shaped member by guiding the same at an outlet side from the extending direction of the wire material toward a radially outward direction relative to the wire material, thereby to wipe off the stain attached on the surface of the wire material by the cord shaped member, and blowing air to the surface of the wire material which has been wiped by the cord shaped member to blow off a remain of the stain attached on the surface of the wire material.

According to the stain removal device associated with the aspect 1, since the stain removal device includes a winding device for feeding the wire material in a feeding direction and winding the wire material same, on the surface of which the stain such as the scale residue or the smut is attached, a cord shaped member which is wound on the wire material and wipes off the stain attached on the surface of the wire material by a sliding movement relative to the wire material and a cord shaped member feeding device for feeding the cord shaped member relative to the wire material by drawing the cord shaped member in a radial direction relative to the wire material and guiding the same at an inlet side for the cord shaped member to be extended and fed in a feeding direction thereof along an extending direction of the wire material and wound around the wire material in a spiral manner and thereafter drawing out the cord shaped member by guiding the same at an outlet side from the extending direction of the wire material toward a radially outward direction relative to the wire material, the stain such as scale residue or smut attached on the surface of the wire material can be removed without using chemicals or the ultrasonic waves or the like. Accordingly, a waste liquid processing facility for disposing the chemicals or an expensive ultrasonic wave facility is not necessary, and thereby a compact and inexpensive stain removal device can be realized.

According to the stain removal device associated with the aspect 2, since the air blowing device is provided for blowing off the stain remained on the surface of the wire material, even if the stain remains on the surface of the wire material after the wire material is wiped by the cord shaped member, such remain of the stain can be blown off from the surface of the wire material by the air blowing device. Thus, the removal of the smut or the like as the pre-processing of the plating processing can be surely carried out.

According to the stain removal device associated with the aspect 3, since the feeding direction of the wire material by the wire material winding device is set to be a same direction with the feeding direction of the cord shaped member by the cord shaped member feeding device, the stain wiped off by the cord shaped member is fed in the direction same to the advancing direction of the wire material. Thus, the stain can be effectively removed.

According to the stain removal device associated with the aspect 4, since the cord shaped member feeding device includes a guide roller for guiding at the inlet side the cord shaped member drawn in the radial direction relative to the wire material to be extended along an extending direction of the wire material, a guide roller for drawing out the cord shaped member by guiding the cord shaped member at the outlet side from the extending direction of the wire material toward the radially outward direction relative to the wire material, a feed out roller for feeding out one end of the cord shaped member at the outlet side and a restricting device for restricting a movement another end of the cord shaped member at the inlet side, the cord shaped member which has wiped off the stain on the surface of the wire material is removed from the surface of the wire material and a clean cord shaped member is supplied on the wire material. This can continuously remove the stain such as the scale residue or the smut on the surface of the wire material over a long period of time.

According to the stain removal device associated with the aspect 5, since the water supply device which is provided at an upper stream side in the feeding direction of the wire material with respect to the cord shaped member wound on the wire material to drop water on the surface of the wire material, smut or the like that cannot be wiped off by a dry type can be surely wiped off by only dropping water on the surface of the wire material.

According to the stain removal device associated with the aspect 6, since the cord shaped member is formed by a hemp cord which has a high water absorption property, the stain such as scale residue or smut can be removed by an inexpensive, but highly strong hemp cord.

According to the stain removal device associated with the aspect 7, since a plurality of stain removal devices is arranged in the direction of the feeding of the wire material, the surface of the wire material can be repeatedly wiped by a plurality of the cord shaped members of the plurality of stain removal devices and accordingly, an accurate and sure removal of the stain on the surface of the wire material can be achieved.

According to the stain removal method associated with the aspect 8 since the stain removal method for removing a stain such as a scale residue or a smut on a surface of a wire material includes the steps of linearly feeding the wire material on the surface of which the stain such as the scale residue or the smut is attached, drawing a cord shaped member in a radial direction relative to the wire material, guiding the cord shaped member at an inlet side for the cord shaped member to be extended and fed in a feeding direction thereof along an extending direction of the wire material and wound around the wire material in a spiral manner and thereafter drawing out the cord shaped member by guiding the same at an outlet side from the extending direction of the wire material toward a radially outward direction relative to the wire material, thereby to wipe off the stain attached on the surface of the wire material by the cord shaped member, and blowing air to the surface of the wire material which has been wiped by the cord shaped member to blow off a remain of the stain attached on the surface of the wire material, the stain such as scale residue or smut on the surface of the wire material can be removed without using chemicals or the ultrasonic waves. Accordingly, a waste liquid processing facility for disposing the chemicals or an expensive ultrasonic cleaning facility is not necessary and a compact and inexpensive stain removal method can be realized.

BRIEF EXPLANATION OF ATTACHED DRAWINGS

EMBODIMENTS FOR IMPLEMENTING INVENTION

A stain removal device and a stain removal method for removing a stain such as a scale residue or a smut, which is associated with the embodiments of the invention will be explained hereinafter with reference to the attached drawings.

Figure 1:
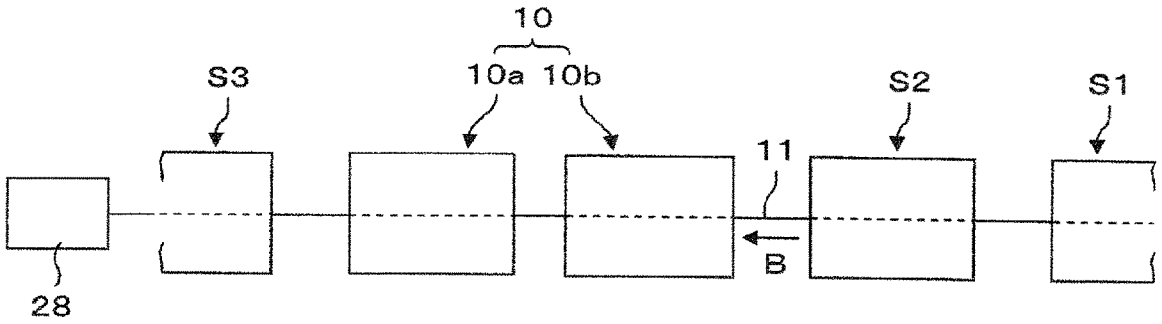
FIG. 1 illustrates a first embodiment of the invention showing an overview of a plating processing line provided with a smut removal device.

FIG. 1 indicates a smut removal device 10 according to the first embodiment of the invention. The smut removal device 10 is disposed between a descaling processing unit S2 in which an oxide layer generated on a wire material 11 at the heat treatment processing unit S1 performed after the wire material 11 has been drawn to a predetermined diameter is removed and a plating processing unit S3. The smut removal device 10 removes a smut formed on the surface of the wire material 11 caused by deoxidizing treatment or the like at the descaling processing unit S2 prior to plating processing.

According to the embodiment, the smut removal device 10 is respectively provided in a plurality of steps (for example, two steps, first step device being a first smut removal device 10*a* and the second step device being a second smut removal device 10*b*), each step device being separately located by a distance in a feeding direction of the wire material 11. The first and the second smut removal devices 10*a* and 10*b* are formed to be the identical structure and the detail structure thereof will be explained by representing the first smut removal device 10*a*.

Figure 2:
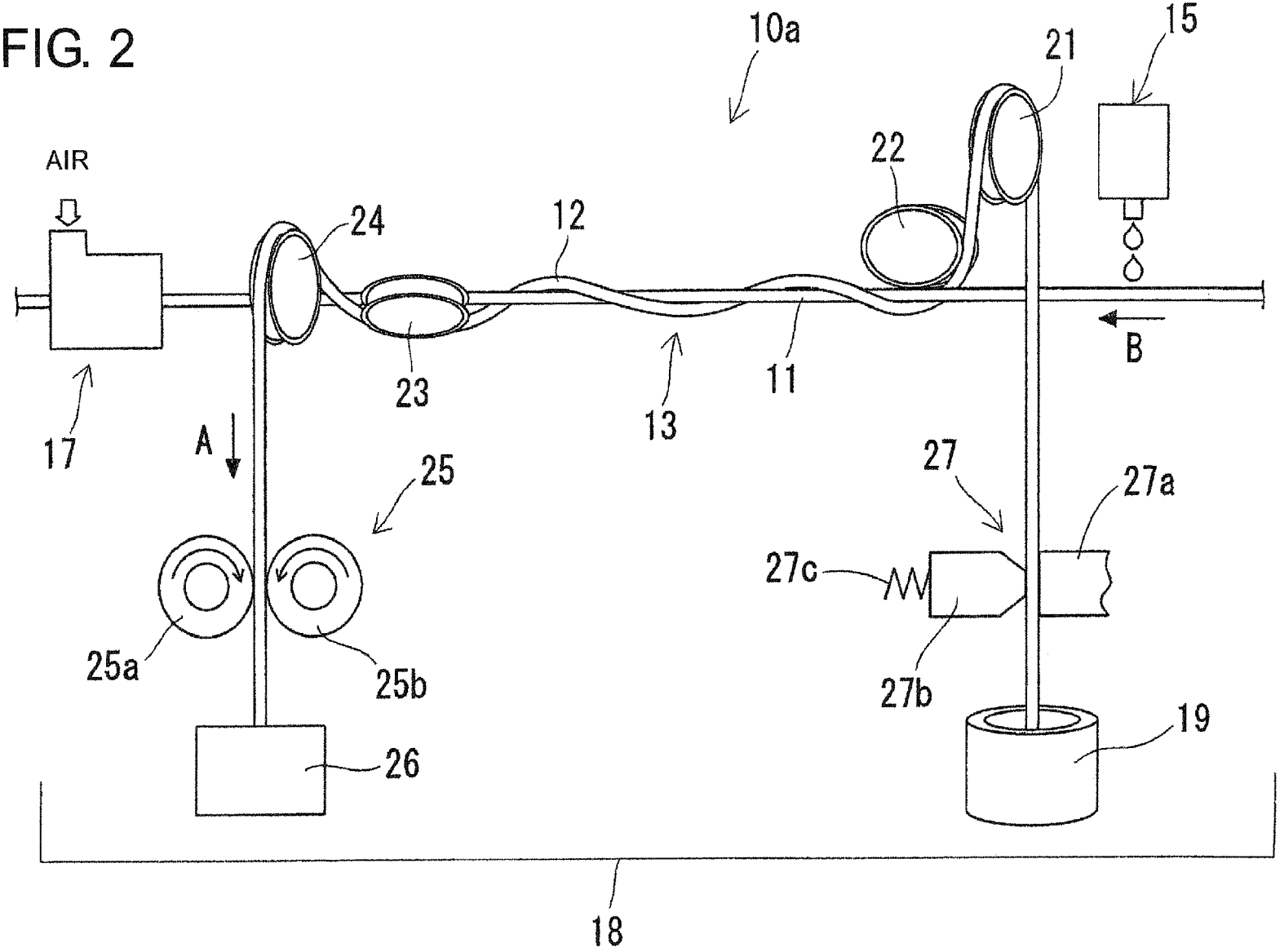
FIG. 2 is a structural view of the smut removal device associated with the first embodiment of the invention.

As shown in FIG. 2, the first smut removal device 10*a* is formed by a cord shaped member feeding device 13 which includes a cord shaped member 12 for wiping the surface of the wire material 11 by being wound around the wire material 11, a water supply device 15 for dropping water on the wire material 11 on which the cord shaped member 12 is wound, an air blowing device 17 for blowing off particles of smut remained on the surface of the wire material 11 whose surface has been wiped by the cord shaped member 12 and a recovery pan 18 which recovers used cord shaped members 12 and the particles of the smut which have been blown off by the air.

The cord shaped member 12 is for example, formed by a hemp cord which is easy to absorb water and has a good wiping performance effect due to the fluffing characteristic. A commercially available hemp cord may be used which is wound in a polar winding 19 and is continuously drawn out therefrom when in use. However, the cord shaped member 12 is not limited to the hemp cord, but a chemical fiber cord or a kite cord may be also used.

The cord shaped member feeding device 13 includes a plurality of guide rollers 21 through 24 which is rotatably supported on a support bed (not shown). The cord shaped member 12 is drawn in a radial direction relative to the wire material 11 and guided by the two guide rollers 21 and 22 at the inlet side to extend along an extending direction of the wire material 11 to be wound around the wire material 11 in a spiral manner in two or three rounds. Thereafter, the cord shaped member 12 is drawn out, being guided by the two guide rollers 23 and 24 at the outlet side from the extending direction of the wire material 11 to the radially outward direction of the wire material 11. The cord shaped member 12 is guided by the guide rollers 21 through 24 at both inlet and outlet sides to be always kept in an approximately constant spiral shape relative to the wire material 11.

The cord shaped member feeding device 13 includes a feed out roller device 25 which has a pair of rollers 25*a* and 25*b* to pinch the cord shaped member 12 at one end side thereof. The pair of rollers 25*a* and 25*b* of the feed out roller device 25 is rotated mutually in opposite directions by a motor (not shown) as indicated with the arrows and thus the one end side of the cord shaped member 12 is fed out in an arrow A direction in FIG. 2 and as a result, the cord shaped member 12 which has been wound around the wire material 11 slides along on the surface of the wire material 11 relative thereto. It is noted here that the numeral 26 shown in FIG. 2 designates a recovery box for recovering the used cord shaped member 12.

Further, the cord shaped member feeding device 13 includes a limiting device 27 for limiting the movement of the cord shaped member 12 at the other end side thereof. The limiting device 27 includes a fixed member 27*a*, a movable member 27*b* which is approachable to or separable from the fixed member 27*a* and a pushing member 27*c* such as a spring. The fixed member 27*a* and the movable member 27*b* hold the cord shaped member 12 therebetween by the pushing member for movably supporting the cord shaped member 12. Thus the cord shaped member 12 is fed along on the surface of the wire material 11, always being given an appropriate tension by the limiting device 27.

The wire material 11 is continuously fed by a wire material winding device 28 (See FIG. 1) with a feeding speed of 100 m/min (meter per minute) to 300 m/min in a B arrow direction in FIGS. 1 and 2. On the contrary, the cord shaped member 12 is continuously fed with a very slow feeding speed of around 100 mm/min (millimeter per minute) in the same direction to the wire material 11. According to this feeding, the cord shaped member 12 which is wound on the wire material 11 in two or three rounds is not too strongly tightened on the wire material 11 and is not pulled by the feeding movement of the wire material 11. It is noted that the diameter of the cord shaped member 12 is preferably slightly smaller than the diameter of the wire material 11, for example, when the diameter of the wire material 11 is about 3 to 5 mm (millimeter), the diameter of the cord shaped member 12 is preferably around 2 to 4 mm.

The water supply device 15 is provided at the upper stream side of the feeding direction of the wire material 11 with respect to the location of the first smut removal device 10*a*. The water supply device 15 supplies water by dropping the water intermittently on the surface of the wire material 11 so that even a smut which is difficult to be wiped off by a dry type can be wiped off. The water supply device 15 is structured to drop water intermittently on the wire material 11 to wet the surface of the wire material 11 at an interval of a predetermined distance and regarding to the use volume of water, an extremely small amount would suffice.

Figure 3:
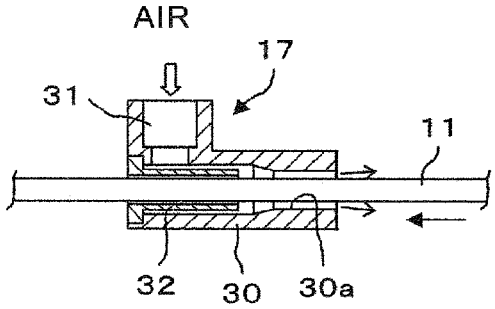
FIG. 3 is a view showing an air blowing device associated with the first embodiment of the invention.

On the other hand, the air blowing device 17 is provided at the lower stream side of the feeding direction of the wire material 11 with respect to the location of the first smut removal device 10*a*. The air blowing device 17 is formed with a cylindrical member 30 with an insertion bore 30*a* for movably inserting the wire material 11 therethrough as shown in FIG. 3. A slight circumferential gap is provided between the outer peripheral portion of the wire material 11 and an opening end of the insertion bore 30*a* for flow throttling purpose.

An air supply port 31 to be connected to an air supply source (not shown) is provided at the cylindrical member 30. Further, the cylindrical member 30 is provided with a deflecting member 32 for deflecting the flow direction of the air supplied from the air supply port 31 towards the opening end of the insertion bore 30*a*, which is the opposite direction to the feeding direction of the wire material 11. Thus, when the pressurized air is supplied from the air supply port 31, the direction of air flow is deflected to the direction opposite to the feeding direction of the wire material 11 and the pressurized air is ejected from the opening end of the insertion bore 30*a* as an air-jet.

Next, the method for removing the smut deposited on the surface of the wire material 11 using the smut removal device 10 as explained above will be explained hereinafter.

By feeding the wire material 11 by the wire material winding device 28, a relative sliding movement is generated between the surface of the wire material 11 and the cord shaped member 12 and the smut formed on the surface of the wire material 11 is wiped off by the cord shaped member 12. Since the cord shaped member 12 is also continuously fed in the direction same to the feeding direction of the wire material 11, the cord shaped member 12 which has become dirty by the smut wiping off operation is removed from the surface of the wire material 11 and replaced by a clean new cord shaped member 12 which is supplemented and wound on the surface of the wire material 11.

Further, in a state that the surface of the wire material 11 is kept wet by water supplied by the water supply device 15, the wire material 11 is wiped by the cord shaped member (hemp cord) 12 which is easy to absorb water and accordingly, the smut which cannot be wiped off by the dry type can be easily removed by the cord shaped member 12 formed by a hemp cord. Thus, the smut on the surface of the wire material 11 can be continuously and effectively removed.

Furthermore, when the wire material 11, which has been cleaned by the cord shaped member 12, is fed to the air blowing device 17, residual smut particles on the surface of the wire material 11 still remained after wiping processing by the cord shaped member 12 are blown off by the air jet ejected from the opening end of the insertion bore 30*a*. Thus, the surface of the wire material 11 which is to be fed for the plating processing unit S3 (See FIG. 1) has been cleaned by removing any stain remained on the surface of the wire material 11 and a highly accurate plating processing can be expected to be performed. It is noted that the smut particles blown off from the wire material 11 by the air blowing device 17 are recovered in the recovery pan 18.

According to the smut removal device 10 and the smut removal method of the first embodiment of the invention explained above, since the surface of the wire material 11 is wiped to remove the smut on the surface thereof by the cord shaped member 12 which is wound on the wire material 11, the smut on the surface of the wire material 11 can be sustainably and stably removed without a use of expensive ultrasonic wave method or a use of chemicals which are necessary for waste liquid treatment after the use thereof.

Still further, by using an inexpensive and yet high-strength hemp cord as the cord shaped member 12, the removal of the smut can be easily performed in a low cost and at the same time since the hemp cord is easy to absorb water and has a fluffing characteristic, the smut wiping off effect can be highly improved. In addition, since the continuous cord shaped member 12 feeding is adopted, the cord shaped member 12 which has wiped off the stain deposited on the surface of the wire material 11 is removed from the wire material 11 and instead, a clean cord shaped member 12 is supplied on the wire material 11. This can keep the smut removal effect high for a long period of time.

Further, according to the first embodiment of the invention, since the residual smut particles on the surface of the wire material 11 are blown off by the air blowing device 17, the residual smut particles on the surface of the wire material 11 remained even after wiping by the cord shaped member 12 are surely removed. Thus, the smut removal processing as a pre-processing of plating can be surely performed and a highly precise plating processing can be performed.

Still further, according to the first embodiment of the invention as explained above, since the feeding direction of feeding the wire material 11 and the feeding direction of feeding the cord shaped member 12 are set to be the same direction, the stain wiped off by the cord shaped member 12 is fed in the direction same to the advancing direction of the wire material 11. Thus, the stain can be effectively removed and at the same time, the feeding of the cord shaped member 12 can be smoothly performed without being firmly tightened to the wire material 11.

Further, according to the first embodiment of the invention as explained above, since the water supply device 15 is provided at an upper stream side of the feeding direction of the wire material to drop water on the surface of the wire material 11, smut or the like that cannot be wiped off by a dry type can be surely wiped off by simply dropping water on the surface of the wire material 11.

Further, according to the first embodiment of the invention as explained above, since the smut removal device 10 is respectively provided in a plurality of steps (10*a* and 10*b*) arranged in the direction of the feeding of the wire material 11, the surface of the wire material 11 can be repeatedly wiped by the plurality smut removal devices 10*a* and 10*b*. Accordingly, a removal of the stain on the surface of the wire material 11 can be accurately and surely achieved.

Next, the scale residue removal device 100 according to the second embodiment of the invention will be explained hereinafter with reference to FIGS. 4 and 5.

Figure 4:
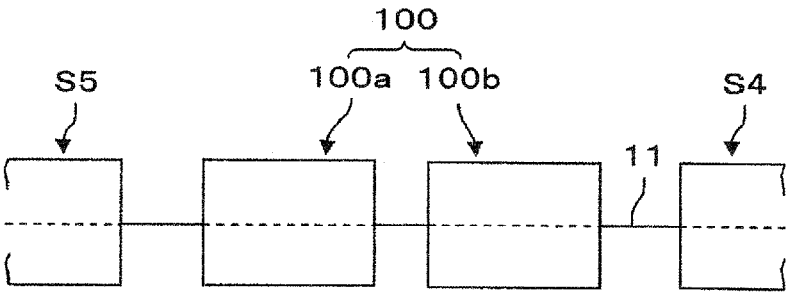
FIG. 4 illustrates a second embodiment of the invention showing an overview of a wire drawing processing line provided with a scale residue removal device.

The scale residue removal device 100 removes the residual scale residue remained by a mechanical de-scaling processing which is a pre-processing for a wire drawing processing of a wire material, and as shown in FIG. 4, the scale residue removal device 100 is arranged between a mechanical descaling processing unit S4 and a wire drawing processing unit S5. The scale residue removal device 100 is respectively provided in a plurality of steps (for example, two steps, first step being a first scale residue removal device 100*a* and the second step being a second scale residue removal device 100*b*), each step device being separately located by a distance apart in a feeding direction of the wire material 11.

The scale residue removal devices 100*a* and 100*b* are formed to be a similar structure as the smut removal devices 10*a* and 10*b* of the first embodiment and accordingly, the structures of the components which are the same with those of the first embodiment will be referenced with the same numerals or symbols only and detail explanation thereof will be omitted.

Figure 5:
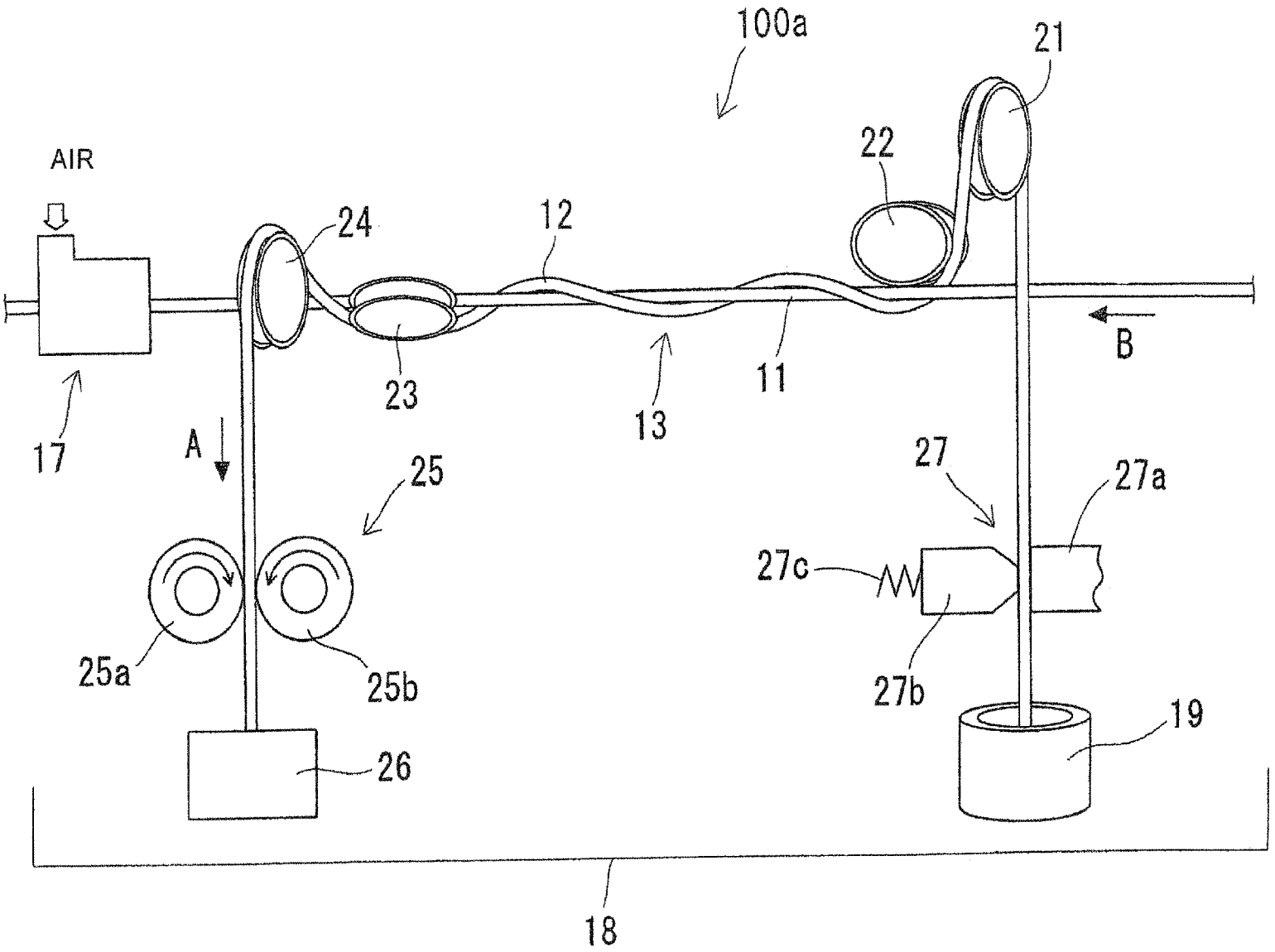
FIG. 5 is a structural view of the scale residue removal device associated with the second embodiment of the invention.

As shown in FIG. 5, the scale residue removal device 100 includes the cord shaped member feeding device 13 which includes the cord shaped member 12 wound on the wire material 11, the air blowing device 17 for blowing off particles of scale residue remained on the surface of the wire material 11 which surface has been wiped by the cord shaped member 12 and the recovery pan 18 which recovers used cord shaped members 12 and the particles of the scale residue which have been blown off by the air. It is noted that the water supply device which drops water on the surface of the wire material 11 is omitted to explain from the scale residue removal device 100.

According to the second embodiment of the invention, by feeding the wire material 11, a relative sliding movement is generated between the surface of the wire material 11 and the cord shaped member 12 and thereby the scale residue remained on the surface of the wire material 11 is wiped off by the cord shaped member 12. Further, by feeding the cord shaped member 12, the cord shaped member 12 which has become dirty by wiping off the scale residue is replaced by a clean new cord shaped member 12 which is supplemented and is wound on the surface of the wire material 11.

Furthermore, when the wire material 11 which has been wiped by the cord shaped member 12 is fed to the air blowing device 17, remaining scale residue on the surface of the wire material 11 remained even after wiping processing by the cord shaped member 12 are blown off by air jet ejected from the opening end of the insertion bore 30*a*.

According to the second embodiment of the invention, since the scale residue remained on the surface of the wire material 11 has been removed by wiping the surface of the wire material with the cord shaped member 12 which is wound around the surface of the wire material 11, the scale residue can be sustainably and stably removed without a use of a conventional expensive ultrasonic cleaning facility or the like.

Further, according to the embodiments explained above, the stain removal devices 10 and 100 for removing the stain such as scale residue or the smut are respectively arranged in two steps (10*a*, 10*b* and 100*a*, 100*b*) in the feeding direction of the wire material 11. However, the number of steps of the stain removal devices 10 and 100 to be provided may be either one or more than two.

According to the embodiments explained above, the cord shaped member 12 is continuously fed with a very slow speed relative to the wire material 11. However, the cord shaped member 12 may be intermittently fed for a fixed amount per every fixed time.

According to the embodiments explained above, the water supply device 15 for watering on the surface of the wire material 11 and the air blowing device 17 for blowing off the stain remained on the surface of the wire material 11 are provided in the respective embodiments. However, the water supply device 15 and the air blowing device 17 may be provided, depending on the necessity thereof and the both devices are not necessarily be inevitable element of the invention.

The present invention has been explained based on some embodiments hitherto, but the invention is not limited to these embodiments and any variations or modifications will be included in the scope of the invention, as long as such are not exceeding the scope of the inventions described in the claims.

INDUSTRIAL APPLICABILITY OF THE INVENTION

The stain removal device and stain removal method according to the invention are applicable to the manufacturing lines in which the wire drawing processing for bead wire is included.

The invention claimed is:

1. A stain removal device for removing a stain on a surface of a wire material whose diameter is 3 to 5 millimeters, comprising:

a wire material winding device for continuously feeding the wire material with a feeding speed of 100 in/min to 300 m/min in a feeding direction and winding the wire material, on the surface of which the stain is attached;

a cord shaped member which is formed by a hemp cord and is 2 to 4 millimeters in diameter and is wound on the wire material and wipes off the stain attached on the surface of the wire material by a sliding movement relative to the wire material;

a cord shaped member feeding device; and an air blowing device for blowing air to the surface of the wire material which has been wiped by the cord shaped member to blow off a remain of the stain attached on the surface of the wire material, wherein the cord shaped member feeding device is configured to feed the cord shaped member in a same direction as the feeding direction of the wire material with a feeding speed of around 100 mm/min which includes two guide rollers at an inlet side for guiding the cord shaped member drawn in a radial direction relative to the wire material for the cord shaped member to extend along an extending direction of the wire material so as to be wound around the wire material in a spiral manner in two or three rounds, two guide rollers at an outlet side for guiding the cord shaped member toward the radially outward direction relative to the wire material from the extending direction of the wire material, a feed out roller for feeding out one end of the cord shaped member at the outlet side and a restricting device for restricting a movement of another end of the cord shaped member at the inlet side by holding the cord shaped member between a fixed member and a movable member pushed by a pushing member to give an appropriate tension to the cord shaped member, wherein the air blowing device includes a cylindrical member with an insertion bore for movably inserting the wire material there through, and a deflection member provided in the insertion bore at a first end side of the insertion bore, the deflection member having a cylindrical shape for movably inserting the wire material there through and for deflecting a flow direction of the air supplied from an air supply source towards an opening end which is located at a second end side of the insertion bore, which is an opposite direction to the feeding direction of the wire material, and wherein the air, which flow direction is deflected by the deflection member flowing towards the opening end located at the second end side of the insertion bore, is ejected from the opening end, after passing through a first circumferential gap formed between an inner peripheral surface of the insertion bore and an outer peripheral surface of the deflecting member, and passing through a second circumferential gap formed at the opening end of the insertion bore between the inner peripheral surface of the insertion bore and an outer peripheral surface of the wire material.

2. The stain removal device according to claim 1, further comprising:

a water supply device which is provided at an upper stream side in the feeding direction of the wire material with respect to the cord shaped member wound on the wire material to drop water on the surface of the wire material.

3. The stain removal device, wherein a plurality of stain removal devices according to claim 1 is arranged in the feeding direction of the wire material.

4. A stain removal method for removing a stain on a surface of a wire material whose diameter is 3 to 5 millimeters using a stain removing device that includes a wire material winding device for continuously feeding the wire material with a feeding speed of 100 m/min to 300 m/min in a feeding direction and winding the wire material, on the surface of which the stain is attached, a cord shaped member which is formed by a hemp cord and is 2 to 4 millimeters in diameter and is wound on the wire material and wipes off the stain attached on the surface of the wire material by a sliding movement relative to the wire material, a cord shaped member feeding device, and an air blowing device for blowing air to the surface of the wire material which has been wiped by the cord shaped member to blow off a remain of the stain attached on the surface of the wire material, wherein the cord shaped member feeding device is configured to feed the cord shaped member in a same direction as the feeding direction of the wire material with a feeding speed of around 100 mm/min which includes two guide rollers at an inlet side for guiding the cord shaped member drawn in a radial direction relative to the wire material for the cord shaped member to extend along an extending direction of the wire material so as to be wound around the wire material in a spiral manner in two or three rounds, two guide rollers at an outlet side for guiding the cord shaped member toward the radially outward direction relative to the wire material from the extending direction of the wire material, a feed out roller for feeding out one end of the cord shaped member at the outlet side and a restricting device for restricting a movement of another end of the cord shaped member at the inlet side by holding the cord shaped member between a fixed member and a movable member pushed by a pushing member to give an appropriate tension to the cord shaped member, wherein the air blowing device includes a cylindrical member with an insertion bore for movably inserting the wire material there through, and a deflection member provided in the insertion bore at a first end side of the insertion bore, the deflection member having a cylindrical shape for movably inserting the wire material there through and for deflecting a flow direction of the air supplied from an air supply source towards an opening end which is located at a second end side of the insertion bore, which is an opposite direction to the feeding direction of the wire material, the method comprising:

linearly continuously feeding the wire material with a feeding speed of 100 m/min to 300 m/min, on the surface of which the stain is attached;

drawing a cord shaped member, which is formed by a hemp cord and 2 to 4 millimeter in diameter, in a radial direction relative to the wire material;

guiding the cord shaped member by two guide rollers at an inlet side for the cord shaped member to be extended in a feeding direction of the cord shaped member along an extending direction of the wire material and wound around the wire material in a spiral manner in two or three rounds;

drawing out the cord shaped member by guiding the cord shaped member by two guide rollers at an outlet side from the extending direction of the wire material toward a radially outward direction relative to the wire material;

feeding out one end of the cord shaped member in a radial direction relative to the wire material with a feeding speed of around 100 mm/min at the outlet side;

restricting a movement of another end of the cord shaped member at the inlet side by holding the cord shaped member between a fixed member and a movable member pushed by a pushing member to give an appropriate tension to the cord shaped member; and including process for blowing air to the surface of the wire material which has been wiped by the cord shaped member to blow off a remain of the stain attached on the surface of the wire material, the blown air, which flow direction is deflected by the deflection member, flows towards the opening end located at the second end side of the insertion bore and is ejected from the opening end after passing through a first circumferential gap formed between an inner peripheral surface of the insertion bore and an outer peripheral surface of the deflecting member, and after passing through a second circumferential gap formed at the opening end of the insertion bore between the inner peripheral surface of the insertion bore and an outer peripheral surface of the wire material.

* * * * *